US005619121A

United States Patent [19]

Trainor

[11] Patent Number: 5,619,121

[45] Date of Patent: Apr. 8, 1997

[54] LOAD VOLTAGE BASED TAP CHANGER MONITORING SYSTEM

[75] Inventor: John J. Trainor, Wake Forest, N.C.

[73] Assignee: Siemens Energy & Automation, Inc., Alpharetta, Ga.

[21] Appl. No.: 496,808

[22] Filed: Jun. 29, 1995

[51] Int. Cl.[6] ..... G05F 1/147

[52] U.S. Cl. ..... 323/256; 323/263

[58] Field of Search ..... 323/256, 257, 323/263, 260, 258, 340, 341, 343; 307/31, 32; 364/483, 492

[56] References Cited

U.S. PATENT DOCUMENTS

| | | | |
|---|---|---|---|
| 3,622,867 | 11/1971 | Topper et al. | 323/341 |
| 4,419,619 | 12/1983 | Jindrick et al. | 323/257 |
| 5,119,012 | 6/1992 | Okamura | 323/258 |
| 5,408,171 | 4/1995 | Eitzmann et al. | 323/258 |
| 5,545,974 | 8/1996 | Trainor et al. | 323/340 |

*Primary Examiner*—Peter S. Wong
*Assistant Examiner*—Adolf Berhane
*Attorney, Agent, or Firm*—Donald M. Boles, Esq.

[57] ABSTRACT

A tap changer including a tap positionable to vary the winding ratio of the transformer in response to changes in an electric load on the transformer is disclosed herein. The transformer includes an electric drive which is electrically powered to selectively position the tap to effect incremental changes of the winding ratio. The transformer includes a monitoring system which monitors the load voltage of the transformer with at least one potential transformer which produces signals which are converted to digital data values stored in a circular data buffer. Each time control signals are applied to the electric drive and a subsequent tap change indication is detected, the first and last data values in the circular buffer are compared, and when the difference between the values exceeds a predetermine limit, the system updates a tap position value which represents the position of the tap.

18 Claims, 2 Drawing Sheets

LOAD VOLTAGE BASED TAP CHANGER MONITORING SYSTEM

FIELD OF THE INVENTION

The present invention relates to a tap changer (e.g. voltage regulator) having a plurality of tap positions selectable to adjust the performance of the transformer based upon the electrical load thereon. In particular, the present invention relates to monitoring the load voltage of the transformer for a predetermined time prior to and a predetermined time after a tap changer occurs, using the difference in the before and after load voltage readings to determine the direction of travel of the tap, and using this information along with prior knowledge of the tap position in order to determine the new tap position.

BACKGROUND OF THE INVENTION

In service, a tap changer is supplied with an input voltage and in response thereto produces an output voltage. The purpose of a tap changer is to produce an output voltage that is well regulated (i.e., substantially constant at some predetermined target level) despite fluctuations in the input voltage and load from their normal values. An AC voltage regulator for industrial use typically comprises a tap changer having a number of spaced-apart output terminals and performs its regulatory function by adjusting the tap position (in other words, tapping the output terminals at a selected position) so that, for a given input voltage, the output is taken from whichever tap yields an output voltage closest to the target level.

The number of taps provided depends on the environment in which the tap changer is designed to operate and the fineness or resolution with which it is necessary to control the output voltage. One type of tap changer in common use has the equivalent of 33 taps. These taps can be thought of as consisting of a centrally positioned neutral tap, 16 taps on one side of the neutral tap respectively corresponding to excursions of the input voltage of increasing magnitude in one direction from normal, and 16 taps on the opposite side of neutral respectively corresponding to excursions of the input voltage of increasing magnitude in the opposite direction from normal. In practice, such a tap changer has a neutral tap plus first through eighth additional taps and a reversing switch. The tap changer can be placed on the neutral tap to yield an output voltage equal to the input voltage. With the reversing switch in the "raise" position, the tap changer can be placed on the neutral and first taps for a one-raise, entirely on the first tap for a two-raise, on the first and second taps for a three-raise, entirely on the second tap for a four-raise, and so on until the tap changer is entirely on the eighth tap for a sixteen-raise. With the reversing switch in the "lower" position to reverse the current through the coil, the tap changer can be moved in the same way over the same taps to obtain any lower position ranging from a one-lower to a sixteen-lower.

The dynamic range at the input side is typically the normal input voltage plus or minus 10%. When the input voltage is at its normal value, the voltage regulator tap position is normally in neutral and the output voltage of the voltage regulator is equal to the input voltage.

Operators of large industrial electrical installations employing voltage regulators with tap changers need information about tap positions because of its bearing on economy of operation, maintenance, safety, and system performance. Consider the matter of economy of operation.

Sometimes, because of poor performance of a voltage regulator, power is supplied at a voltage which, although not so high as to damage the electrical components that receive power from the tap changer, is higher than the voltage required. In such a case, more power is delivered than is necessary, and the excess power is wasted. In a large industrial application, this waste can be quite substantial.

From the standpoint of maintenance and safety, in certain circumstances it is necessary to move the tap changer quickly and reliably to its neutral position. It is also essential that the tap changer position be in neutral whenever the voltage regulator is placed in or removed from service. Information about current tap position is therefore necessary to accomplish this. From the standpoint of system performance, a record of the successive active tap positions of a tap changer is a useful measure of the range and frequency of input voltage excursions and load changes, which are related respectively to the performance of the power supply to the tap changer and to the performance of the system (load) to which the tap changer supplies power.

Various kinds of apparatus have been developed in the past for determining the tap position of a tap changer. These prior developments have culminated in standard electromechanical tap position indicator, which are physically attached as an add-on to the tap changer mechanism, a mechanical device that changes the tap position by physically moving from tap to tap. The attached tap position indicator moves with the tap changer mechanism and displays the tap position on a dial or in some other conventional manner.

The standard, conventional electromechanical meter has a number of drawbacks. For one, it has costly moving parts that wear out and is inherently less reliable and more expensive than desirable. Moreover, it produces only a local meter indication, which can be read by an operator only by going to the site of the meter. Furthermore, if meter readings are converted into a signal that can be transmitted to a remote location for reading or to a centrally located computer for processing, such conversion must be performed reliably and cost effectively.

Other prior art relating to the monitoring or determination of the tap position of a tap changer is found in U.S. Pat. Nos. 4,419,619, 4,612,617 and 5,119,012. The devices shown in these patents all have various drawbacks, including relative complexity and a failure to provide certain information or a failure to provide information in a form desired by operators of large industrial installations incorporating voltage regulators.

In view of the foregoing, it would be desirable to provide a remedy for the problems of the prior art outlined above. In particular, it would be desirable to provide improved monitoring apparatus and methods for use with a tap changer that reliably and inexpensively keep track of the tap position as it changes. Furthermore, it would be desirable to provide monitoring apparatus that provides information on tap position in a form that is convenient and easily accessible either at the tap changer or at a remote location to elevate standards of economy, maintenance, safety, and system performance.

SUMMARY OF THE INVENTION

The present invention provides a transformer having a variable winding ratio. The transformer includes at least one load terminal, a plurality of windings including a tap assembly which is positionable to incrementally change the winding ratio of the transformer to vary the voltage at the load terminal, and an electric drive mechanically coupled to the tap assembly to selectively position the tap assembly to effect incremental changes of the winding ratio. A monitoring circuit is coupled to the load terminal to produce a load voltage signal representative of the load voltage at the load terminal, and a digital processing circuit includes an input port coupled to the monitoring circuit and an output port coupled to the electric drive. The processing circuit compares load voltage values sampled before and after a count signal, determines the direction of tap change based upon the comparison of the load voltage values, and determines a new tap position value based upon this calculated direction of tap change.

Another embodiment of the transformer includes at least one load terminal, a plurality of windings including a tap assembly which is positionable to incrementally change the winding ratio of the transformer to vary the voltage at the load terminal, a drive means, a monitoring means and a processing means. The drive means selectively positions the tap assembly in response to control signals to effect incremental changes of the winding ratio, and the monitoring means produces a load voltage signal representative of the load voltage at the load terminal. The processing means periodically samples the load voltage signal, compares load voltage signals sampled before and after a count signal, determines the direction of tap change based upon the comparison of the load voltage values, and determines a new tap position value based upon this calculated direction of tap change.

The present invention further provides a method useable in a transformer of the type having a selectable winding ratio, a plurality of windings including a tap assembly which is positionable to incrementally change the winding ratio of the transformer to change load voltage at a load terminal of the transformer, and an electric drive mechanically coupled to the tap assembly to selectively position the tap assembly to effect incremental changes of the winding ratio. The method includes the steps of monitoring the load terminal to generate a load voltage signal representative of the load voltage at the load terminal, periodically sampling the load voltage signal to generate a plurality of digital data values representative of the load voltage signals, and applying power to the electric drive to selectively position the tap assembly to effect incremental changes of the winding ratio. The method also includes the steps of comparing first data representative of the load voltage signal sampled at a first time prior to a count signal with second data representative of a pre-defined load set value, comparing third data representative of the load voltage value sampled at a third time prior to a count signal to a fourth data representative of a fourth load voltage value sampled at a time subsequent to the count signal, determining the direction of tap change based upon the comparison of the third and fourth data, and determining a new tap position value based upon this calculated direction of tap change.

BRIEF DESCRIPTION OF THE DRAWINGS

Reference may be now had to the accompanying drawings in which.

DETAILED DESCRIPTION OF THE PREFERRED EMBODIMENT

Figure 1:
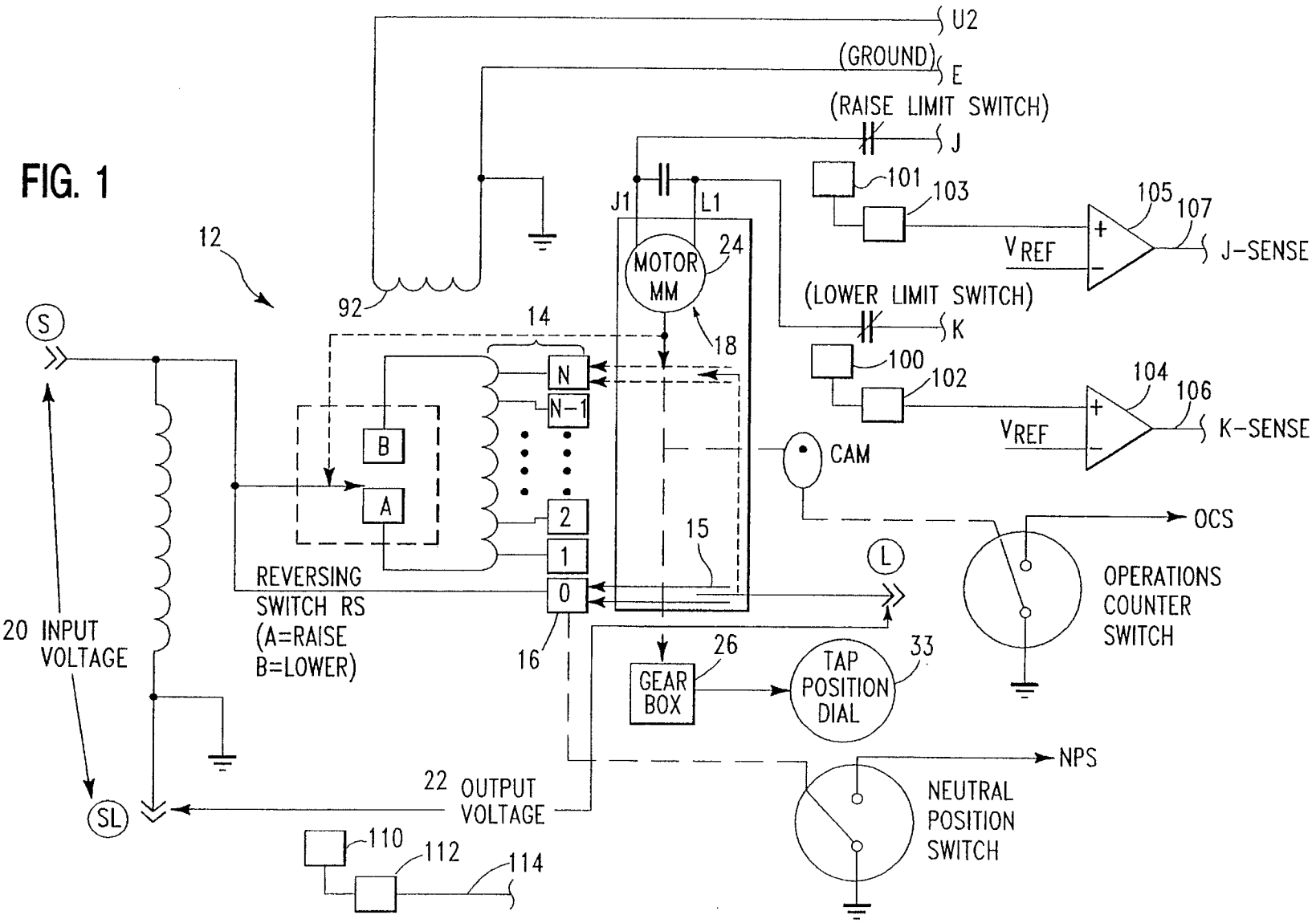
FIG. 1 is a schematic illustration of a tap changer.

Referring to FIG. 1, a tap changer includes a plurality of taps 14 including a neutral tap 0 and taps 1, 2, . . . N-1, N for raising (boosting) or lowering (bucking) the input voltage S. Transformer 12 can be, for example, a Siemens JFR series transformer. Transformer 12 also includes an electrically powered tap changer 18 capable of activating any of the taps 0, 1, 2, . . . N-1, N by moving a movable tap 15 into contact with a desired tap 14. If tap 15 is entirely on the neutral tap 0, the output voltage L (22) is equal to the input voltage S (20). If tap 15 is on the 0 and 1 taps, changer 18 produces a one-raise or a one-lower output, depending on whether the reversing switch RS is on terminal A or on terminal B. If the reversing switch RS is on terminal A, it results in a raise; if it is on terminal B, it results in a lower (unless, of course, the tap changer 18 is on the neutral tap 0). The tap changer 18 can thus move tap 15 from the neutral position 0 through a one-raise to a sixteen-raise (with the reversing switch RS on terminal A) or from a one-lower to a sixteen-lower (with the reversing switch on terminal B). If the dynamic range D is plus or minus 10% with respect to the normal input voltage, each step of the tap changer amounts to an adjustment of the output voltage equal to ⅝% (10÷16)% of D/2. A finer adjustment can be obtained by, for example, providing more taps 14.

In the present embodiment, the energy to move tap 15 is generated by a motor drive 24. Drive 24 may also be mechanically coupled to a tap position dial 33 which provides a visual indication of the tap position at the exterior of transformer 12.

Transformer 12 is thus adapted to receive an input voltage S on a line 20 and to produce an output voltage L on a line 22 and is constructed so that the output voltage on the line 22 bears a relationship to the input voltage on the line 20 that depends on the activated tap 0, 1, 2, . . . N-1, N. Driver 24 of tap changer 18 is controlled by a controller 34 to activate different ones of taps 14 as necessary to maintain the output voltage close to a target level despite fluctuations of the input voltage or load.

Figure 2:
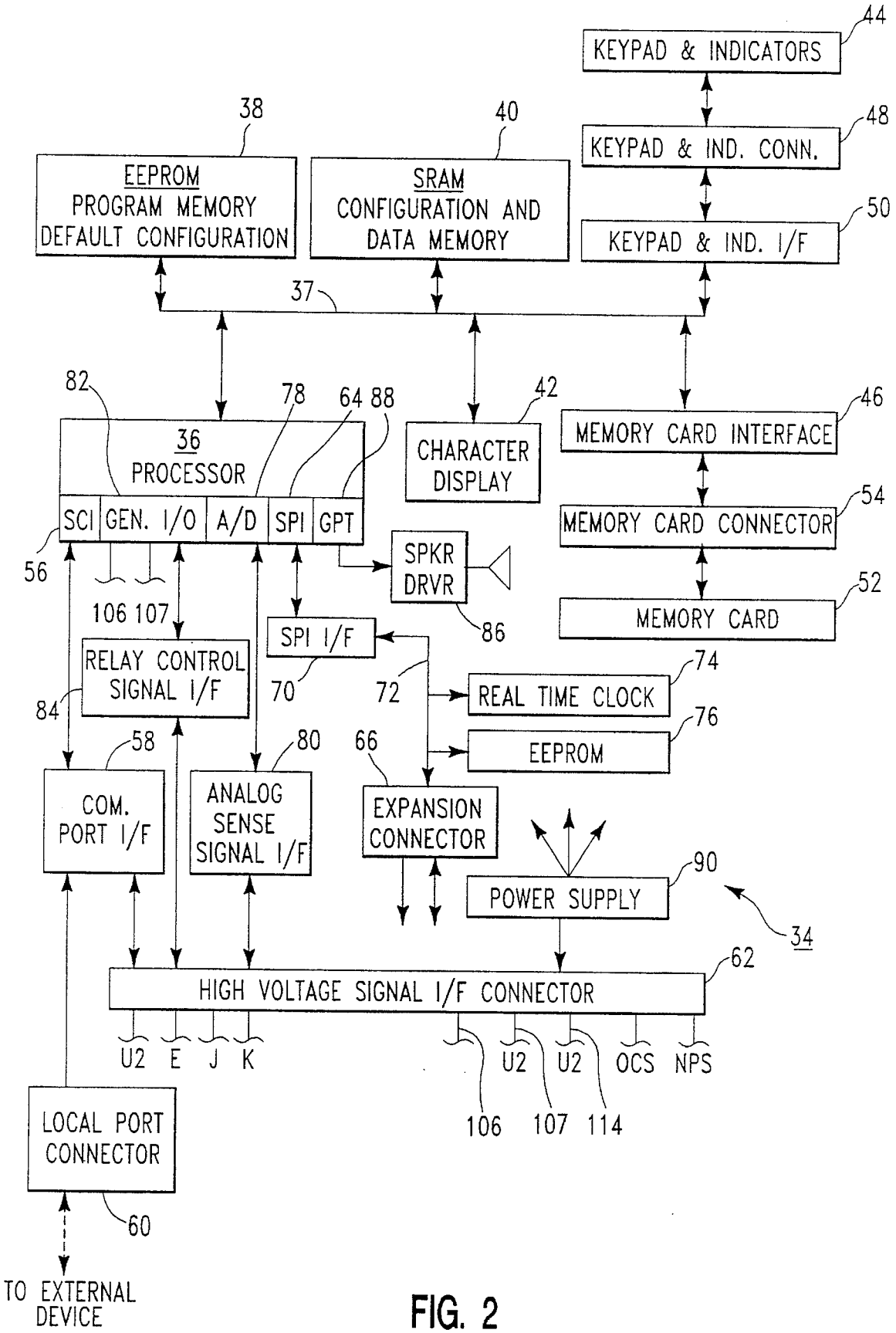
FIG. 2 is schematic diagram of a controller which includes a digital processing circuit which determines the position of the tap in the tap changer.

Referring to FIG. 2, tap changer 18 is coupled to controller 34 by control conductors J and K. Controller 34 includes a digital processing circuit 36 (e.g. Motorola 68HC16 microprocessor), a high voltage interface and connector 62 and a memory card interface 46. Digital data bus 37 couples processor 36 to interface 46.

In general, processor 36 is programmed (configured) to generate digital control signals based on user selected parameters entered via a keypad 44. In operation, transformer 12 operates at relatively high voltages (e.g., thousands of volts). These voltages are monitored by potential transformer 110 (discussed in further detail below) and other internal transformers (not shown) and are provided to the high voltage interface 62. Interface 62, in turn, filters and further scales the signals produced by the internal transformers. The signals produced by interface 62 are applied to an analog-to-digital (A/D) converter 78 which may be integrated in processor 36. A/D converter 78 converts the signals to digital data signals used by the processor 36 to make tap change control decisions and control tap changer 18 based upon such changes.

Memory card interface 46 is disposed in the controller housing (not shown) so that it is accessible from the exterior of the housing. Field changes to the controller's configuration information or the resident memory program of processor 36 can be made by a user plugging a memory card 52 into memory card interface 46 and invoking appropriate commands from keypad 44. Memory card 52 can be left plugged in to collect data or provide a control program, or it can be inserted briefly to transfer information to or from controller 34.

Processor 36 is coupled to the other elements of controller 34 by way of common bus 37. An electrically erasable programmable read only memory (EEPROM) 38 includes the program instructions and default configuration data for processor 36. A static type random access memory (SRAM) 40 stores user programmed configuration data and includes an area for the processor 36 to store working data. Processor 36 is also coupled to alphanumeric character display 42, keypad and indicators 44, and the memory card interface 46 by bus 37. The keypad/indicators 44 are coupled to bus 37 via a connector 48 and a bus interface 50. A memory card 52 can be coupled to the bus 37 by way of an interface 46 (e.g., a conventional PCMCIA interface) and a connector 54.

Operational parameters, setpoints and special functions including metering parameters and local operator interfacing are accessed via the keypad 44. Keypad 44 is preferably of the membrane type; however, any suitable input device can be used. Keypad 44 provides single keystroke access to regularly used functions, plus access (via a menu arrangement) to all of the remaining functions of controller 34.

Processor 36 includes a communications port 56 (e.g., SCI port) which is connected to a communication port interface 58. Interface 58 provides the communications signals to an external local port 60 (accessible on the front panel of controller 34). An isolated power supply for the communication port interface 58 is provided by a high voltage interface via a high voltage signal interface connector 62.

The communication port interface 58 supports bi-directional data transfer which allows controller 34 to be configured via a serial link, and also provides meter, status information, tap position and other data to remote devices.

Processor 36 also includes an SPI port 64 which is connected to an expansion connector 66 by way of an SPI interface 70. The expansion connector 66 provides access to bus 72. Other devices that reside on SPI bus 72 include a real time clock (RTC) 74 and a serial EEPROM 76. Serial EEPROM 76 stores user programmed configuration data. The user programmed configuration data is downloaded to the SRAM 40 by the processor 36 upon initialization. The SRAM 40 copy of the user programmed configuration is used as the working copy of the configuration data. Whenever a configuration change is made, the new information is stored in both SRAM 40 and in serial EEPROM memory 76. Clock 74 is programmed and read by the processor 34.

Scaled analog signals from the high voltage signal interface connector 62 are provided to A/D converter 78 by way of an analog sense signal interface 80. Interface 80 low pass filters the scaled analog input signals prior to application to A/D converter 78. More specifically, analog signals representative of the load on transformer 12 are applied to converter 78 via interface 80.

Control signals from the general I/O port 82 of processor 36 are provided to the high voltage signal interface connector 62 by way of a relay control signal interface 84. Interface 84 converts the voltage levels of I/O port 82 control signals to voltage levels which can operate motor drive 24 of tap changer 18. A speaker driver 86 is connected to the General Purpose Timer (GPT) port 88 of the processor 36. Processor 36 also includes a power supply 90 which provides regulated power to each of the circuit elements of FIG. 2 as needed. Connector 62 provides an unregulated and unrectified power supply via conductors U2 and E from a power winding 92 in transformer 12. The power from winding 92 is rectified and regulated to 5 volts DC by supply 90.

Based upon the signals applied to processor 36 as discussed in further detail below, processor 36 generates a binary data signal representative of the position of tap 15. Processor 36 can also be configured (programmed) to apply the data signal to SCI port 56 which applies a binary data communications signal to communications port interface 58. Furthermore, processor 36 can convert the data signal representative of tap position to display signals which processor 36 applies to character display 42 via databus 36 to generate a visual indication thereon of tap 15 position.

Processor 36 periodically samples (e.g. every 100 milliseconds) the status of output 107 (J-sense=raise sense input) and 106 (K-sense=lower sense input) to determine the tap change direction (raise or lower) when a tap change is detected. Accordingly, outputs 106 and 107 determine current in the lower (K) and raise (J) motor control signals and thereby determine which motor control signal is active. Current transformers and amplifier 101 and 103 respectively are used for detecting motor current for the J motor signal. Similarly, current transformers and amplifier 100 and 102 respectively are used for detecting motor current for the K motor signal. For every sampling of 106 and 107, if the raise signal is active, an up/down counter is incremented. Similarly, if a lower signal is active the up/down counter is decremented. The up/down counter stops incrementing/decrementing at a predefined maximum positive or maximum negative value (e.g. +10 and −10). Thereafter, when a tap change is detected via the operations count input signal, the processor 36 determines the direction of the tap change based on the value of the up/down counter. At that point, the tap tracking algorithm adjusts its internally stored tap position accordingly.

The above discussed process for determining the direction of tap change is also used to account for momentum and inertia of the tap changer mechanical system. For example, a raise tap request may be asserted for 3–4 seconds when voltage conditions dictate that the raise tap request be removed. The tap changer may subsequently complete the tap change due to momentum of springs in the tap changer. Maintaining a history of the prior tap direction requests tells processor 36 which direction the tap changer moved.

After processor 36 determines the occurrence and direction of a tap change, the tap position value is incremented in the appropriate direction. When the maximum tap position value is reached, processor 36 makes no further changes to increase the tap position value and when the minimum tap position value is reached, processor 36 makes no further changes to decrease the value. Since the tap position values are relative to their previous values, initialization of the tap position value is required. This initialization is performed when processor 36 senses that tap 15 is in the neutral position.

Upon determining the position of tap 15, processor 36 generates a binary data signal representative of the position of tap 15, which may be communicated or used by processor 36 as required by the system.

Depending upon the configuration of and application for transformer 12, it may not be possible or practical to utilize the arrangement discussed above for determining and keeping track of the position of tap 15. More specifically, due to the adaptability of voltage regulators having tap changers many may be configured for a forward power flow mode or a reverse power flow mode. It has been found that it is therefore important to take this into account when predicting tap position in that for forward power flow modes, a positive "L" voltage changes indicates that a raise has occurred while a negative "L" voltage change indicates a lower occurred. Similarly for a reverse power flow mode configuration, a positive "S" voltage change indicates that a lower has occurred while a negative "S" voltage change indicates that a raise has occurred. Therefore it can be seen that the calculation of the tap position could be exactly opposite of its real position if the user configuration does not take into account whether the tap changer is in the forward or reverse power flow mode.

Further, in the presently preferred embodiment of an arrangement for determining the position of tap 15 includes using a potential transformer (PT) 110 to monitor the load voltage at the output of transformer 12. PT 110 is coupled (e.g. magnetically coupled) to load conductor L to monitor the load voltage. PT 110 is coupled to a conditioning (i.e. amplifying and filtering) circuit 112 which applies a conditioned signal representative of the load voltage to connector 62 via conductor 114.

A/D 78 converts the conditioned signal to a digital data signal representative of the load voltage, and processor 36 periodically samples the digital data signal to generate RMS data representative of the digital data. In addition to the other operations of processor 36, processor 36 keeps track of the position of tap 15 by monitoring the VLD RMS data values before and after a tap change takes place. (The tap changer indicates when the tap change takes place by activating the operations count signal from the OCS switch (FIG. 1).)

More specifically, processor 36 maintains an internally stored value for the tap position. The tap position value has a maximum value corresponding to the extreme raise position of tap 15, and a minimum value corresponding to the extreme lower position of tap 15. (For example, the tap position value corresponding to 16 raise could be +16, while the tap position value corresponding to 16 lower could be −16. Neutral would be represented as zero.)

After processor 36 applies a motor control signal and subsequently senses a tap change (via operations count input), processor 36 increments or decrements the tap position value based on the tap change direction. As discussed above, the processor monitors VLD RMS value to determine the tap change direction.

Turning more specifically to the analysis of the values of the RMS data by processor 36, processor 36 periodically (e.g. every 100 msec.) stores RMS data in a circular data buffer residing in memory 40 having a plurality of values (e.g. 1, 2, . . . M RMS values, where M could be in the range of 20). After applying a control signal to tap changer 18, processor 36 waits for a tap change to be detected (via operations count input signal). After the tap change and a predetermined time period (e.g. 0.5 to 2 seconds), the processor compares the oldest and newest values in the circular buffer. If the difference between the oldest and newest values exceed a predetermined minimum, processor 36 uses the sign of the difference to determine the tap change direction.

As discussed above, when the maximum tap position is reached, processor 36 makes no further changes to increase the tap position value, and when the minimum tap position is reached, processor 36 makes no further changes to decrease the tap position value. Also, since tap changes are relative to each other, initialization of the register is required. Initialization (synchronization) is performed when the processor senses that the tap is at the neutral position. This is done when processor 36 senses a signal generated by the Neutral Position Switch (NPS) of the tap changer called "neutral" (or "NPS") when the neutral signal is active (i.e. the tap position is on neutral). If tap position is not equal to neutral at power up, the tap position is unknown until the neutral position is encountered.

Once the processor tap position value is initialized/synchronized (by arriving at or going through neutral), the processor can track the tap position. Each time the neutral input signal goes active, the processor has the opportunity to verify its tap position (or correct it, if the tap position has gotten off).

Upon determining the position of tap 15, processor 36 generates a binary data signal representative of the position of tap 15, and is communicated and used by processor 36 as discussed above in reference to the use of motor current (J,K) to determine tap position.

The preferred embodiment of the invention has been described in detail herein, and various modifications, enhancements and improvements which do not depart from the scope and spirit of the invention will become apparent to those of skill in the art. Thus, it should be understood that the preferred embodiment has been provided by way of example and not by way of limitation. The scope of the invention is defined by the appended claims.

What is claimed is:

1. A transformer having a selectable winding ratio comprising:

at least one load terminal;

a plurality of windings including a tap assembly which is positionable to incrementally change the winding ratio of the transformer to vary the voltage at the load terminal;

an electric drive mechanically coupled to the tap assembly to selectively position the tap assembly to effect incremental changes of the winding ratio;

a count signal generator coupled to the tap assembly to generate a count signal in response to a tap change;

a monitoring circuit coupled to the load terminal to produce a load voltage signal representative of the load voltage at the load terminal; and a digital processing circuit including an input port coupled to the monitoring circuit and count signal generator, and an output port coupled to the electric drive, the processing circuit being configured to periodically sample the load voltage signal applied to the input port, compare a first load voltage value sampled at a first time with a pre-defined load set value, apply control signals to the output port to activate the electric drive if the difference between the first and second voltage values exceeds a predetermined limit, compare a third load voltage value sampled at a third time prior to a count signal with a fourth load voltage value sampled at a time subsequent to the count signal, determine the direction of tap change based upon the comparison of the third and fourth load voltage values, and determine a new tap position value based upon the direction of tap change.

2. The transformer of claim 1, wherein the digital processing circuit includes a microprocessor and an analog-to-digital converter coupled between the input port and the microprocessor to convert the load voltage signals to digital data values representative thereof.

3. The transformer of claim 2, wherein the digital processing circuit further includes a digital data memory, the microprocessor being further configured to store tap position data in the digital memory representative of the winding ratio and update the tap position data in response to a tap change signal.

4. The transformer of claim 3, further comprising a communications output coupled to the digital processing circuit, wherein the processing circuit applies a communications signal representative of the tap position data to the communications output.

5. The transformer of claim 4, wherein the microprocessor and digital memory are incorporated into a single semiconductor package.

6. The transformer of claim 3, wherein the monitoring circuit includes a potential transformer magnetically coupled to the load terminal.

7. The transformer of claim 3, wherein the monitoring circuit includes a potential transformer magnetically coupled to a conductor coupled to the load terminal.

8. The transformer of claim 3, wherein the microprocessor is configured to maintain a circular data buffer in the memory including a plurality of digital data values representative of load voltages, the two digital data values being the first and last digital data values stored in the circular data buffer.

9. A transformer having a selectable winding ratio comprising:

at least one load terminal;

a plurality of windings including a tap assembly which is positionable to incrementally change the winding ratio of the transformer to vary the voltage at the load terminal;

drive means for selectively positioning the tap assembly in response to control signals to effect incremental changes of the winding ratio;

count means for generating count signal in response to a tap change;

monitoring means for producing a load voltage signal representative of the load voltage at the load terminal; and processing means for periodically sampling the load voltage signal and count signal to generate digital data values representative thereof, comparing first data representative of the load voltage signal sampled at a first time with second data representative of a pre-defined load set value, applying control signals to the drive means to activate the drive means if the difference between the first and second data exceeds a predetermined limit, comparing third data representative of the load voltage signal sampled at a third time prior to a count signal with fourth data representative of load voltage signals sampled at a time subsequent to the count signal, determining the direction of tap change based upon the comparison of the third and fourth data, and determining a new tap position value based upon the direction of tap change.

10. The transformer of claim 9, wherein the processing means includes a microprocessor and an analog-to-digital converter coupled between the monitoring means and the microprocessor to convert the load voltage signal to digital data values representative thereof.

11. The transformer of claim 10, wherein the processing means further includes a digital data memory, the microprocessor being further configured to store winding ratio data in the digital memory representative of the winding ratio and update the winding ratio data in response to a tap change signal.

12. The transformer of claim 11, further comprising a communications output coupled to the microprocessor, wherein the processing circuit applies a communications signal representative of the winding ratio data to the communications output.

13. The transformer of claim 11, wherein the microprocessor and digital memory are incorporated into a single semiconductor package.

14. The transformer of claim 9, wherein the monitoring means includes a potential transformer magnetically coupled to the load terminal.

15. The transformer of claim 11, wherein the processing means maintains a circular data buffer in the digital data memory including a plurality of digital data values representative of the load voltages, the two digital data values being the first and last digital data values stored in the circular data buffer.

16. In a transformer of the type having a selectable winding ratio, a plurality of windings including a tap assembly which is positionable to incrementally change the winding ratio of the transformer to change load voltage at a load terminal of the transformer, and an electric drive mechanically coupled to the tap assembly to selectively position the tap assembly to effect incremental changes of the winding ratio, a method comprising the steps of:

monitoring the load terminal to generate a load voltage signal representative of the load voltage at the load terminal;

periodically sampling the load voltage signal to generate a plurality of digital data values representative of the load voltage signals;

applying power to the electric drive to selectively position the tap assembly to effect incremental changes of the winding ratio;

comparing first data representative of the load voltage signal sampled at a first time prior to a count signal with second data representative of a pre-defined load set value;

comparing third data representative of the load voltage value sampled at a third time prior to a count signal to a fourth data representative of a fourth load voltage value sampled at a time subsequent to the count signal;

determining the direction of tap change based upon the comparison of the third and fourth data; and determining a new tap position value based upon the direction of tap change.

17. The method of claim 16, further comprising the step of storing winding ratio data representative of the winding ratio in a digital data memory, and updating the winding ratio data in response to a tap change signal.

18. The method of claim 17, further comprising the step of maintaining a circular data buffer in the digital data memory including a plurality of digital data values representative of load voltages, the first and second digital data values being the first and last digital data values stored in the circular data buffer.

* * * * *